US010634347B2

(12) United States Patent
Johncock et al.

(10) Patent No.: US 10,634,347 B2
(45) Date of Patent: Apr. 28, 2020

(54) APPLIANCE WITH ELECTRONICALLY-CONTROLLED GAS FLOW TO BURNERS

(71) Applicant: WHIRLPOOL CORPORATION, Benton Harbor, MI (US)

(72) Inventors: James Charles Johncock, Shelbyville, MI (US); Cristiano Vito Pastore, Comerio (IT)

(73) Assignee: Whirlpool Corporation, Benton Harbor, MI (US)

( * ) Notice: Subject to any disclaimer, the term of this patent is extended or adjusted under 35 U.S.C. 154(b) by 182 days.

(21) Appl. No.: 15/806,807

(22) Filed: Nov. 8, 2017

(65) Prior Publication Data

US 2018/0066844 A1 Mar. 8, 2018

Related U.S. Application Data

(63) Continuation of application No. 14/693,043, filed on Apr. 22, 2015, now Pat. No. 9,841,191.

(51) Int. Cl.

| | |
|---|---|
| ***F23K 5/00*** | (2006.01) |
| ***F23N 5/02*** | (2006.01) |
| ***F23N 1/00*** | (2006.01) |
| ***F24C 3/12*** | (2006.01) |

(52) U.S. Cl.

CPC ..... *F23N 5/022* (2013.01); *F23K 5/005* (2013.01); *F23N 1/002* (2013.01); *F23N 1/005* (2013.01); *F23N 1/007* (2013.01); *F23N 5/025* (2013.01); *F24C 3/12* (2013.01); *F23K 2900/05003* (2013.01); *F23N 2035/14* (2013.01)

(58) Field of Classification Search

USPC ..... 431/72; 123/399

See application file for complete search history.

(56) References Cited

U.S. PATENT DOCUMENTS

| | | | |
|---|---|---|---|
| 4,195,558 | A | 4/1980 | Speakman |
| 4,391,265 | A | 7/1983 | Chen |
| 4,997,161 | A | 3/1991 | Hutchison et al. |
| 5,146,941 | A | 9/1992 | Statler |
| 5,241,463 | A | 8/1993 | Lee |

(Continued)

FOREIGN PATENT DOCUMENTS

| | | | |
|---|---|---|---|
| EP | 0657693 | A2 | 6/1995 |
| EP | 2957831 | A1 | 12/2015 |
| WO | 2009040115 | A2 | 4/2009 |

*Primary Examiner* — Avinash A Savani

(74) *Attorney, Agent, or Firm* — Price Heneveld LLP

(57) ABSTRACT

An appliance includes a first gas-burning heating element, a first gas path extending from an inlet to the first heating element, and a first solenoid valve positioned within the first gas path. The appliance further includes a second gas path extending from upstream of the first solenoid valve to the first heating element and supplying a base gas flow to the first heating element. A controller is electronically coupled with the first solenoid valve for controlling a supplemental flow of gas through the first gas path to the first heating element such that the supplemental gas flow combines with the base gas flow to achieve a total gas flow. The controller controls the supplemental flow to adjust the total gas flow by pulsing the first solenoid valve at a first rate corresponding to a desired rate of the total gas flow to the first heating element.

17 Claims, 4 Drawing Sheets

(56) References Cited

U.S. PATENT DOCUMENTS

| | | | | |
|---|---|---|---|---|
| 5,575,638 | A | 11/1996 | Witham et al. | |
| 5,813,320 | A | 9/1998 | Frasnetti et al. | |
| 5,924,857 | A | 7/1999 | Frasnetti et al. | |
| 5,938,425 | A | 8/1999 | Damrath et al. | |
| 6,116,230 | A | 9/2000 | Clifford et al. | |
| 6,619,613 | B1 | 9/2003 | Akamatsu et al. | |
| 7,150,626 | B2 | 12/2006 | Clauss et al. | |
| 7,201,186 | B2 | 4/2007 | Ayastuy | |
| 7,255,100 | B2 | 8/2007 | Repper et al. | |
| 7,513,247 | B2 | 4/2009 | Clauss et al. | |
| 7,669,590 | B2 | 3/2010 | Oberhomburg | |
| 8,028,968 | B2 | 10/2011 | Gum | |
| 8,678,345 | B2 | 3/2014 | Gum | |
| 2004/0202975 | A1* | 10/2004 | Bird | F23N 5/022 431/75 |
| 2008/0216810 | A1* | 9/2008 | Clauss | F23N 1/005 126/42 |
| 2009/0159068 | A1* | 6/2009 | Querejeta | A47J 37/0713 126/25 R |
| 2014/0150731 | A1 | 6/2014 | Huang et al. | |

* cited by examiner

APPLIANCE WITH ELECTRONICALLY-CONTROLLED GAS FLOW TO BURNERS

CROSS-REFERENCE TO RELATED APPLICATION

This application is a continuation of and claims priority to U.S. patent application Ser. No. 14/693,043, now U.S. Pat. No. 9,841,191, filed on Apr. 22, 2015, entitled "APPLIANCE WITH ELECTRONICALLY-CONTROLLED GAS FLOW TO BURNERS," the disclosure of which is hereby incorporated herein by reference in its entirety.

BACKGROUND

The present device generally relates to a fuel supply arrangement for a gas-powered cooking appliance, and more specifically, to the use of fuel injectors in a gas supply line to control a flow of gas to one or more burners.

Gas-powered cooking appliances, such as stand-alone cooking hobs or cooking hobs included in gas or multi-fuel ranges often include individual knobs that are manually rotatable for direct manipulation of valves that control the flow of gas to the individual burners. Locations for such knobs are restricted due to the knobs requiring mechanical connection with the valves themselves. Further the mechanically-adjustable valves associated therewith offer limited precision in control of the resulting heat output of the associated burners. Accordingly further advances are desired.

SUMMARY

In at least one aspect, an appliance includes a first gas-burning heating element, a first gas path extending from an inlet to the first heating element, and a first solenoid valve positioned within the first gas path. The appliance further includes a second gas path extending from upstream of the first solenoid valve to the first heating element and supplying a base gas flow to the first heating element. A controller is electronically coupled with the first solenoid valve for controlling a supplemental flow of gas through the first gas path to the first heating element such that the supplemental gas flow combines with the base gas flow to achieve a total gas flow.

In at least another aspect, a cooking hob includes a first burner assembly, a first gas path extending from an inlet to the first burner assembly, and a first fuel injector positioned within the first gas path. A controller is electronically coupled with the first fuel injector for controlling a flow of gas through the first gas path to the first heating element by pulsing the first fuel injector at a first rate corresponding to a desired gas flow to the first heating element.

In at least another aspect, a cooking hob includes a first gas-burning heating element, a first gas path extending from an inlet to the first heating element, and a first solenoid valve positioned within the first gas path. The cooking hob further includes a second gas path extending from upstream of the first solenoid valve to the first heating element and supplying a base gas flow to the first heating element. A controller is electronically coupled with the first solenoid valve for controlling a supplemental flow of gas through the first gas path to the first heating element. The supplemental gas flow combines with the base gas flow to achieve a total gas flow, and the controller controls the supplemental flow to adjust the total gas flow by pulsing the first solenoid valve at a first rate corresponding to a desired rate of the total gas flow to the first heating element.

These and other features, advantages, and objects of the present device will be further understood and appreciated by those skilled in the art upon studying the following specification, claims, and appended drawings.

DETAILED DESCRIPTION OF EMBODIMENTS

Figure 1:
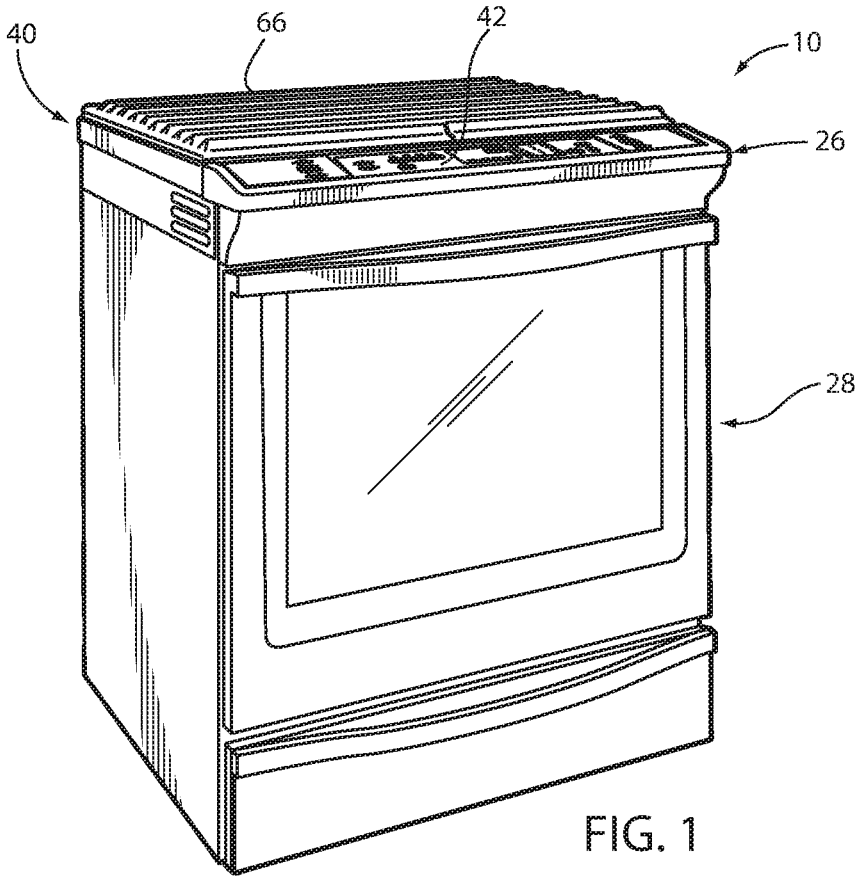
FIG. 1 is a front perspective view of an appliance.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, reference numeral 10 generally designates an appliance. Appliance 10 includes a first gas-burning heating element, which is shown in the form of a burner 12*a* and a first gas path 14 extending from an inlet 16 to the first heating element 12*a*. A first solenoid valve 18*a* is positioned within the gas path 14. A controller 20 is electronically coupled with the first solenoid valve 18*a* for controlling a flow of gas through the first gas path 14 to the first heating element 12*a* by pulsing the first solenoid valve 18*a* at a first rate corresponding to a desired gas flow to the first heating element 12*a*. In one example, the solenoid valve 18*a* can be included in a first field injector 24*a* at least partially positioned within the gas path 14, as described further below.

Figure 2:
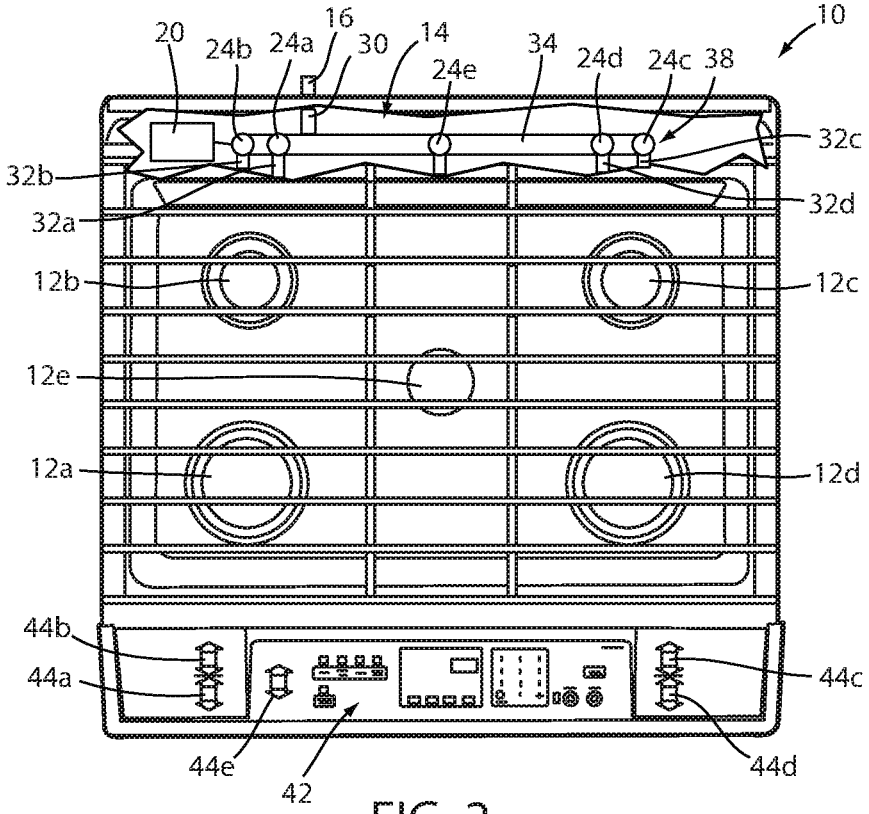
FIG. 2 is a top view of the appliance of FIG. 1 with a partial cutaway thereof illustrating a fuel supply assembly thereof.

As shown in FIGS. 1 and 2, an embodiment of the appliance 10 can be in the form of a gas-powered range 10 including a cooking hob 26 positioned on the top of an oven 28 also included therein. Cooking hob 26 can include a plurality of gas-burning heating elements in the form of various "burners" 12*a*, 12*b*, 12*c*, 12*d*, and 12*e*, as shown in FIG. 2, that can be spaced apart on cooking hob 26 so as to allow multiple articles to be heated thereby simultaneously and using independently variable heat outputs. As further shown in FIG. 2, each burner 12*a*, 12*b*, 12*c*, 12*d*, and 12*e* (which may be referred to generically or collectively as burner 12 or burners 12) has a respective valve 18*a*, 18*b*, 18*c*, 18*d*, and 18*e* (which may be referred to generically or collectively as valve 18 or valves 18) associated therewith, each valve 18*a*, 18*b*, 18*c*, 18*d*, and 18*e* being fluidically coupled with respective burner 12*a*, 12*b*, 12*c*, 12*d*, and 12*e* by a respective branch 32*a*, 32*b*, 32*c*, 32*d*, and 32*e* (also shown in FIG. 3, and which may be referred to generically or collectively as branch 32 or branches 32). Branches 32 can be coupled with supply portion 30 of first gas path 14 by a fuel rail 34 that splits off therefrom and couples with each of the branches 32 with valves 18 positioned within branches 32 or at an intersection of branches 32 with fuel rail 34.

In operation, fuel rail 34 is pressurized gas provided by supply portion 30 of first gas path 14, which may be configured such that the pressure of gas within fuel rail 34 is generally consistent within a predetermined range. In a variation, branches 32 may be coupled directly with supply portion 30 or coupled therewith via a manifold or other structure. Controller 20 is then electrically coupled with valves 18 such that controller 20 can cause pulsing of the individual valves 18, as desired, to achieve a desired flow of gas from out of fuel rail 34 and into branches 32 for use at burners 12. In the illustrated example, such coupling is achieved by a communication line 22, which can be one or more wires or the like. In a variation, controller 20 can wirelessly couple with valves 18 such as by various wireless communication protocols, including RF, Wi-Fi, or various low-power, short-range protocols (e.g. Bluetooth™). In a further example, a heating element for appliance 10 can be an additional burner within oven 28 of the range depicted in FIG. 1. Such an additional burner can include a further respective branch 32 and valve 18 for controlled flow of fuel from fuel rail 34 to such a burner.

The arrangement described above is shown schematically in FIG. 3, in which first gas path 14 includes a supply portion 30 fluidically coupled with a fuel rail 34 with a plurality of branches 32 extending at various locations therefrom and connecting fuel rail 34 with individual burners 12. A plurality of solenoid valves 18 are positioned within branches 32 or, alternatively, at a point of coupling between branches 32 and fuel rail 34. Controller 20 is electronically coupled with solenoid valves, such as by communication line 22, which may be a combination of wires, to control opening and closing of solenoid valves 18, as necessary to achieve a desired fuel flow to burners 12, as discussed further below. As further shown in FIG. 3, a mechanically operated lockout valve 36 can be positioned generally within supply portion 30 of first gas path 14. Lockout valve 36 can, for example, be a ball valve, a globe valve, a gate valve, or a butterfly valve. Lockout valve 36 can be included within first gas path 14 to cut off the fuel supply to fuel rail 34 and, accordingly, burners 12, such as when appliance 10 is not in use.

In an example, controller 20 can be electrically coupled with a motor or the like which may be mechanically coupled with the actuation mechanism for lockout valve 36, such that when a user directs appliance 10, as discussed further below, to ignite one of burners 12 at a user-selected level, controller 20 can cause opening of lockout valve 36, thereby allowing pressurization of fuel rail 34. The solenoid valve 18 corresponding with the particular burner 12 for which ignition is desired can then be further actuated by controller 20 to achieve the desired gas flow for both ignition and steady-state operation of burner 12.

Figure 3:
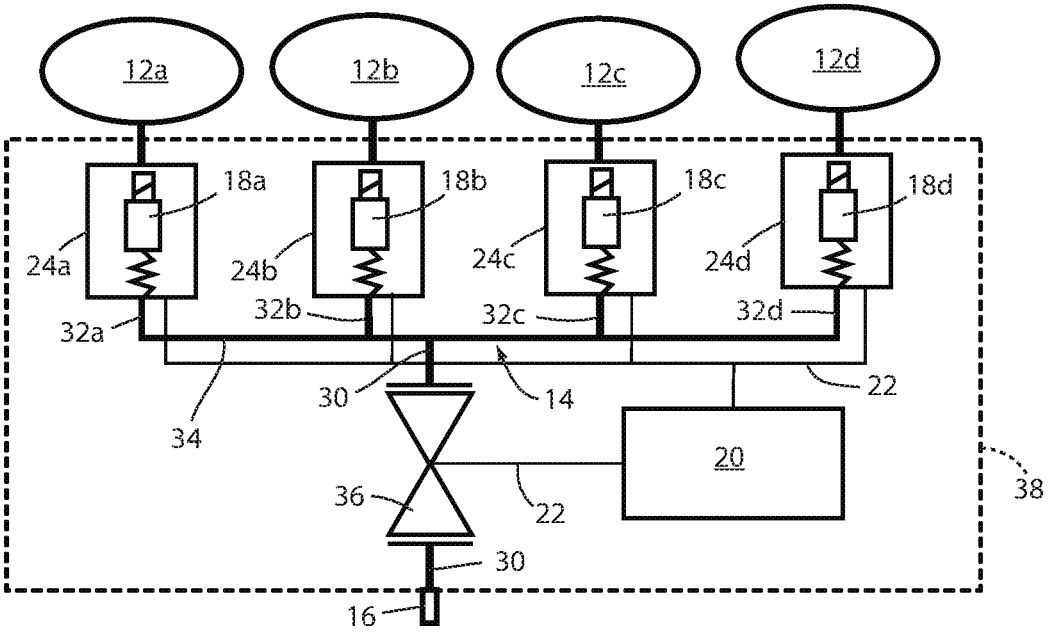
FIG. 3 is a schematic diagram of the fuel supply assembly shown in FIG. 2.

As discussed above, each of solenoid valves 18 (e.g. 18*a*, 18*b*, 18*c*, and 18*d*, as depicted in FIG. 3) can be included in a respective fuel injector 24 (e.g. 24*a*, 24*b*, 24*c*, and 24*d*) as a portion thereof. In a further example, fuel injectors 24 can be automotive type fuel injectors, which may be useful in the system depicted in FIG. 3 due to the high level of control afforded by such fuel injectors 24, particularly with respect to the speed of pulsing thereof and, accordingly, the fuel flow rate thereof. Fuel injectors 24 may also be configured to operate a generally high pressure, so as to achieve a generally high level of responsiveness with respect to such pulsing. In an example, controller 20 can cause pulsing of the various valves 18 within fuel injectors 24 at varying rates according to one or more different user-selected output levels of the respective burners 12, which may be independently adjustable. Controller 20 may be configured to adjust both the duration of and interval between the pulsing of solenoid valves 18 of fuel injectors 24, according to various parameters to achieve a desired flow rate of fuel through branches 32 for desired heat output levels of the respective burners 12.

In one example, controller 20 can cause a series of pulses of valves 18, including executing movement from a closed condition, wherein no gas flow is permitted, to an open condition, in which a full flow rate of gas therethrough is permitted, and back to the closed position, such that valve 18 remains open for about 10 milliseconds. In such operation, controller 20 can cause valves 18 to pulse at respective predetermined rates that can be, for example, between about one pulse per 0.5 seconds and about one such pulse between 20-30 milliseconds. In other control modes, valve 10 may remain open for up to one second and may pulse at a rate of once per 1.5 seconds or up to once per ten seconds. In certain burner configurations and certain configurations of gas path 14, this may provide adequate range of heat output of burners 12 between generally accepted low and high output conditions (and in some embodiments below low output conditions provided by burners controlled by manually-manipulated valves). Different pulse rates are possible depending on such factors, as well as the duration of a particular pulse, as implemented by controller 20. Controller 20 is further configured to pulse various ones of valves 18 simultaneously at different rates to achieve different output levels (including zero output) of the various burners 12, as selected by a user.

Returning now to FIG. 2, it may be desirable to position fuel injectors 24 upstream of burners 12, such that a length of the respective branches 32 is interposed between fuel injector 24 and a corresponding one of burners 12. Such a configuration may allow a quantity of gas injected into a respective one of the branches 32 to disperse throughout the branch 32 such that an aggregate of gas from subsequent pulses pressurizes branch 32 to achieve flow of gas into and out of burner 12. As such, a quantity of gas output from burner 12 can be controlled by pulsing of valve 18 such that a rate of fuel supplied to burner 12 does not fall below the consumption rate of such fuel by burner 12, which would result in extinguishing of burner 12. Further, such a configuration may generally smooth out the appearance of pulsing, particularly at low pulse rates. In an example, a length of branch 32 between burner 12 and a corresponding one of valves 18 may be at least 10 cm.

As further shown in FIG. 2, controller 20, fuel rail 34, fuel injectors 24, and portions of branches 32 and supply portion 30, as well as lockout valve 36 can be included in a fuel supply unit 38 such that all of such components can be accessible within a single area of appliance 10. As illustrated, fuel supply unit 38 can be positioned adjacent a rear portion 40 of the housing of appliance 10 and can further be positioned below cooking hob 26, to minimize noise perceptible by a user from valve 18 perceptible. The ability to position fuel supply unit 38 within such a location within appliance 10 is facilitated by the fact the valves 18 do not have to be adjacent to or in line with the controls provided therefor. As shown in FIG. 2, appliance 10 can be configured with a digital control pad 42, including digital burner controls 44 (e.g., 44*a*, 44*b*, 44*c*, 44*d*, and 44*e*) corresponding to particular ones of burners 12 (e.g. 12*a*, 12*b*, 12*c*, 12*d*, and 12*e*). Control pad 42 can be electrically connected with controller 20 such that a user can select a particular one of burners 12 to be ignited at a particular level, such as by manipulation of the corresponding digital burner control 44, with controller 20 acting appropriately, as described above, to provide a flow of gas to particular burner 12 at the rate corresponding to the desired output level. The incorporation of such a control pad may allow for burner controls 44 to be positioned in more intuitive locations, such as locations which more directly correspond to the locations of burners 12 (e.g., front and back, as well as left side and right side).

In the various examples described herein, gas path 14, including inlet 16 supply portion 30, fuel rail 34, and branches 32 can be constructed one or a combination of various tubes, pipes, or the like, as may typically be used in gas-powered appliances. Such pipes and tubing may be made of various metals, including steel, copper, or the like, as well as various plastics, or combinations of metal and plastic.

Figure 4:
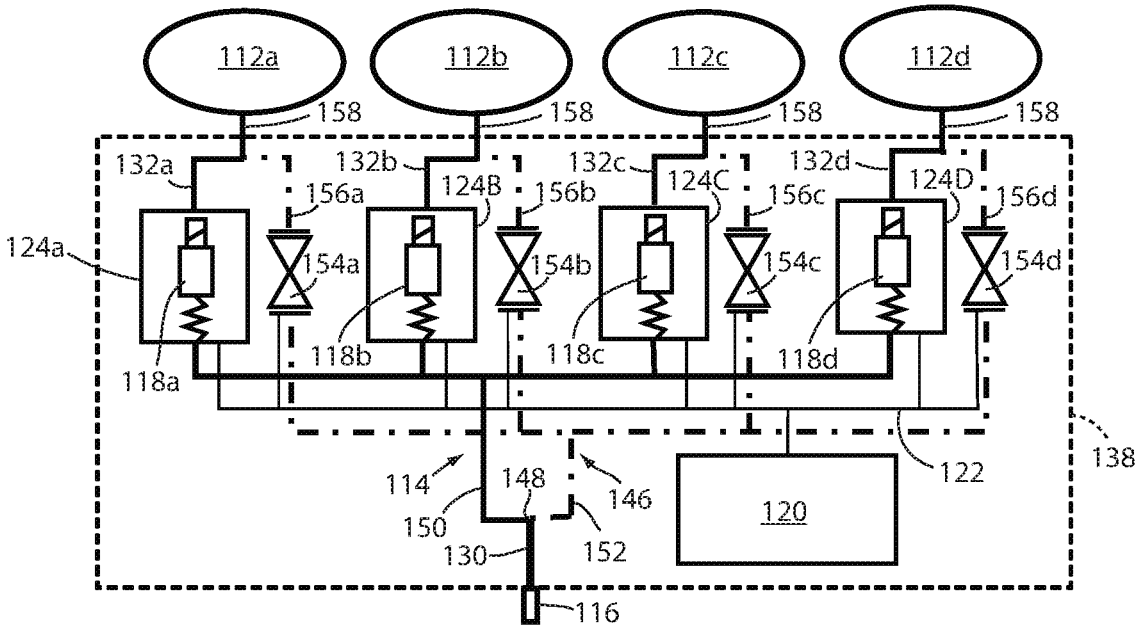
FIG. 4 is a schematic diagram of an alternative fuel supply assembly useable in an appliance.

FIG. 4 shows a second embodiment of a fuel supply unit 138 usable in connection with a gas-powered appliance (such as a variation of the appliance 10 shown in FIGS. 1 and 2, as well as appliance 110 shown in FIG. 5) to provide a controlled output of fuel for one or more burners 112*a*, 112*b*, 112*c*, 112*d*. In particular, fuel supply unit 138 may include a first gas path 114 and a second gas path 146 that is configured to run in parallel with first gas path 114. As shown in FIG. 4, a common supply portion 130 may extend from inlet 116 to a fork 148, at which point the supply portion 130 splits into a first path supply portion 150 and a second path supply portion 152. As in the embodiment of fuel supply unit 38 as discussed above with respect to FIGS. 2 and 3, first gas path 114 has a fuel rail 134 that may be communicatively coupled with branches 132*a*, 132*b*, 132*c*, and 132*d* to provide a first fuel flow for burners 112*a*, 112*b*, 112*c*, and 112*d*, respectively, such flow being controlled by pulses of corresponding valves 118*a*, 118*b*, 118*c*, and 118*d*, which may be included in fuel injectors 124*a*, 124*b*, 124*c*, and 124*d*, as discussed above with respect to FIG. 3. Additionally, second gas path 146 may extend through branches 156*a*, 156*b*, 156*c*, and 156*d* to respective burners 112*a*, 112*b*, 112*c*, and 112*d* to also provide a flow of gas thereto.

In the arrangement depicted in FIG. 4, the fuel flow provided by second gas path 146 may be a base flow of gas for burners 112 at a rate at or near a minimum flow rate sufficient to maintain the desired ones of burners 112 in an ignited state. Accordingly, branches 156*a*, 156*b*, 156*c*, and 156*d* may include respective mechanically-actuated base supply valves 154*a*, 154*b*, 154*c*, and 154*d* that are configured to be positionable between a closed state, in which fuel is permitted to flow to burners 112 is cut off, and an open state in which the base fuel flow to the associated burner 112 is permitted. Controller 120 may be electrically coupled with such base supply valves 154 to change the configuration thereof from a closed state when the burner 112 corresponding thereto is in an off state and to the open position when the associated burner 112 is switched to an on state, regardless of the particular output level selected therefor.

Base supply valves 154 may be of any of the mechanically actuated types described above with respect to lockout valve 36, and additionally may be solenoid valves. In this arrangement, first gas path 114 adds a supplemental gas flow to the base gas flow provided by second gas path 146, the supplemental gas flow being adjustable by controller 120 pulsing the associated solenoid valves 118 with a rate and duration sufficient to produce the desired gas flow when combined with base supply flow, which may be as low as in the range of one pulse per ten seconds, in which one pulse may last, for example, for one second. In another example, the pulse rate may be about one pulse between about 0.9 seconds and about 0.1 seconds with a pulse lasting for between about 0.1 seconds and 0.01 seconds. In the alternative, the pulse rate may be determined as a percentage of pulsing (i.e. opening of the associated valve) during a given "duty cycle." In one such example, pulsing may be such that valve 118 is open for between 1% and 100% of a ten second duty cycle. The duration and rates of pulsing of solenoid valves 118 implemented by controller 120 may be configured in a similar manner to that of valves 18 by controller 20, as discussed above with respect to FIG. 3. As further shown in FIG. 4, the branches 156 and 152 coupled with a particular respective one of burners 112 may merge together to a combined branch 158 (e.g. 158*a*, 158*b*, 158*c*, and 158*d*) that leads into a the associated burner 112 (e.g. 112*a*, 112*b*, 112*c*, and 112*d*). Alternatively, each of branches 132 and 156 may remain separate while connecting with the associated ones of burners 112.

Figure 5:
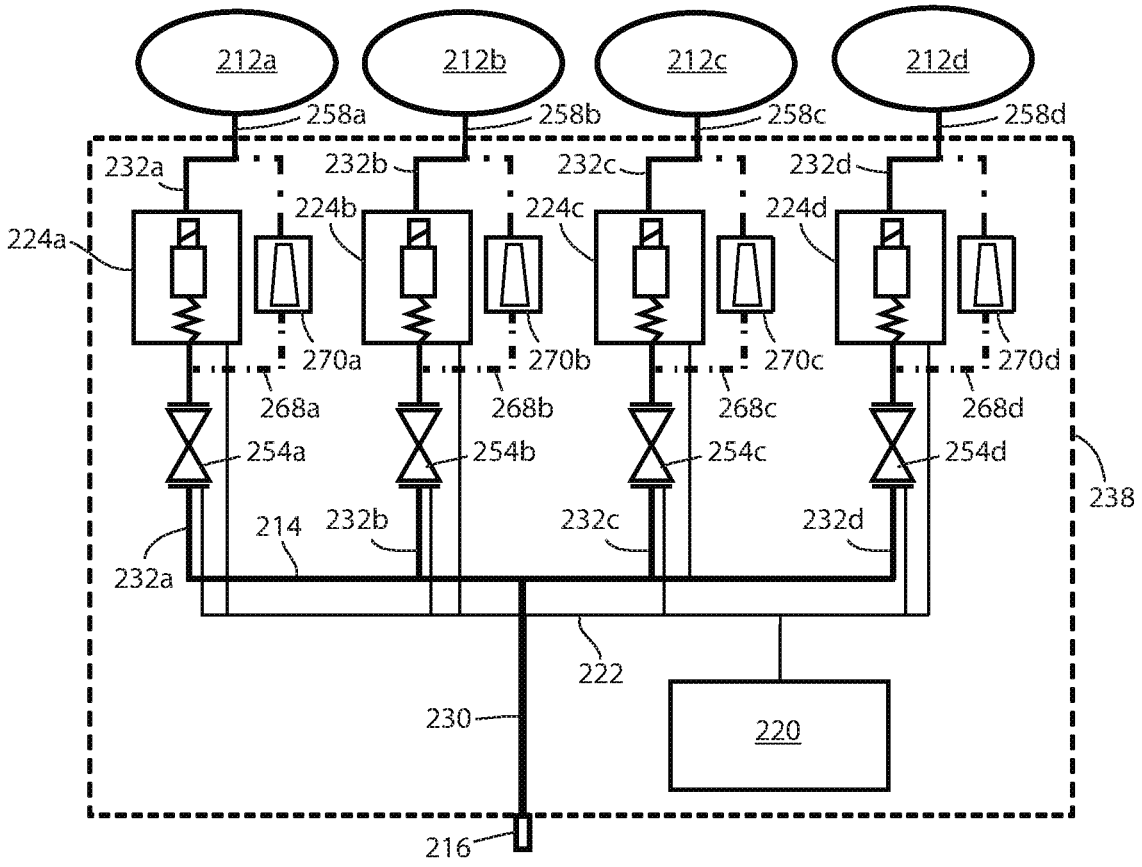
FIG. 5 is a schematic diagram of a further alternative fuel supply assembly useable in an appliance.

FIG. 5 shows a third embodiment of a fuel supply unit 238 usable in connection with a gas-powered appliance (such as a further variation of the appliance 110 shown in FIGS. 1 and 2, as well as the appliance 110 shown in FIG. 6) to provide a controlled output for fuel for one or more burners 212*a*, 212*b*, 212*c*, 212*d*. In particular, fuel supply unit 238 may include a supply line 230 in fluid communication with a gas inlet 216 for the related appliance. Supply line 230 is part of gas path 214 that further includes separate branches 232*a*, 232*b*, 232*c*, 232*d* extending therefrom to provide a supply of fuel for respective burners 212*a*, 212*b*, 212*c*, 212*d*. Such branching may be facilitated by the incorporation of a fuel rail similar to fuel rail 134, discussed with respect to FIG. 4. A respective mechanically-actuated valve 254*a*, 254*b*, 254*c*, 254*d* in respective branches 232*a*, 232*b*, 232*c*, 232*d* can be controllable by controller 220 by way of communication line 222 between a fully open and a fully closed position so as to either cut off or permit a flow of fuel for the respective burners 212*a*, 212*b*, 212*c*, 212*d*. In this manner, when a user desires to use a particular one of burners 212, an appropriate control can be activated on the related appliance, thereby causing the mechanical valve 254 associated with the particular burner 212 to be opened.

Downstream of each mechanically-actuated valve 254*a*, 254*b*, 254*c*, 254*d* a bypass tube 268*a*, 268*b*, 268*c*, 268*d* routes a portion of the fuel flow permitted by the mechanically actuated valve 254*a*, 254*b*, 254*c*, 254*d* through a respective flow bottleneck 270*a*, 270*b*, 270*c*, 270*d*, the respective flow bottlenecks 270 being calibrated to provide a base flow of gas for the respective burners 212 in a manner similar to the second gas path 146 described above with respect to FIG. 4. In this manner, when the respective mechanically-actuated valve 254 is in an open state, the base flow of gas for the respective burner 212 is provided by bypass tube 268, such base flow being at a predetermined minimum flow rate to maintain the respective burner 212 in an ignited state. In a manner similar to that of valves 118 discussed above with respect to FIG. 4, each of branches 232*a*, 232*b*, 232*c*, 232*d* includes a respective solenoid valve 118*a*, 118*b*, 118*c*, 118*d* (which may be included in respective fuel injectors 224*a*, 224*b*, 224*c*, 224*d*, as also discussed above). Such valves 218 being positioned downstream of the coupling of bypass tubes 268 with branch 254. In this manner, the solenoid valves 218 may provide an adjustable, supplemental gas flow for the respective burners 212 that is added to the base gas flow provided by flow bottlenecks 270.

The supplemental gas flow can be adjusted by controller 220 pulsing the associated solenoid valves 218 with a rate and duration sufficient to provide the desired gas flow when combined with the base supply flow, which, as discussed above with respect to FIG. 4, may be as low as in the range of one pulse per second or one pulse per between about 0.9 seconds and about 0.1 seconds. As further shown in FIG. 6, the branches 232 may combine with bypass tubes 268 upstream of both the respective solenoid valve 218 and the respective airflow bottleneck 270 to a combined branch 258 that leads to the associated burner 212. Alternatively, branches 232 and bypass tubes 268 may remain separate while connecting with the associated ones of burners 212.

Figure 6:
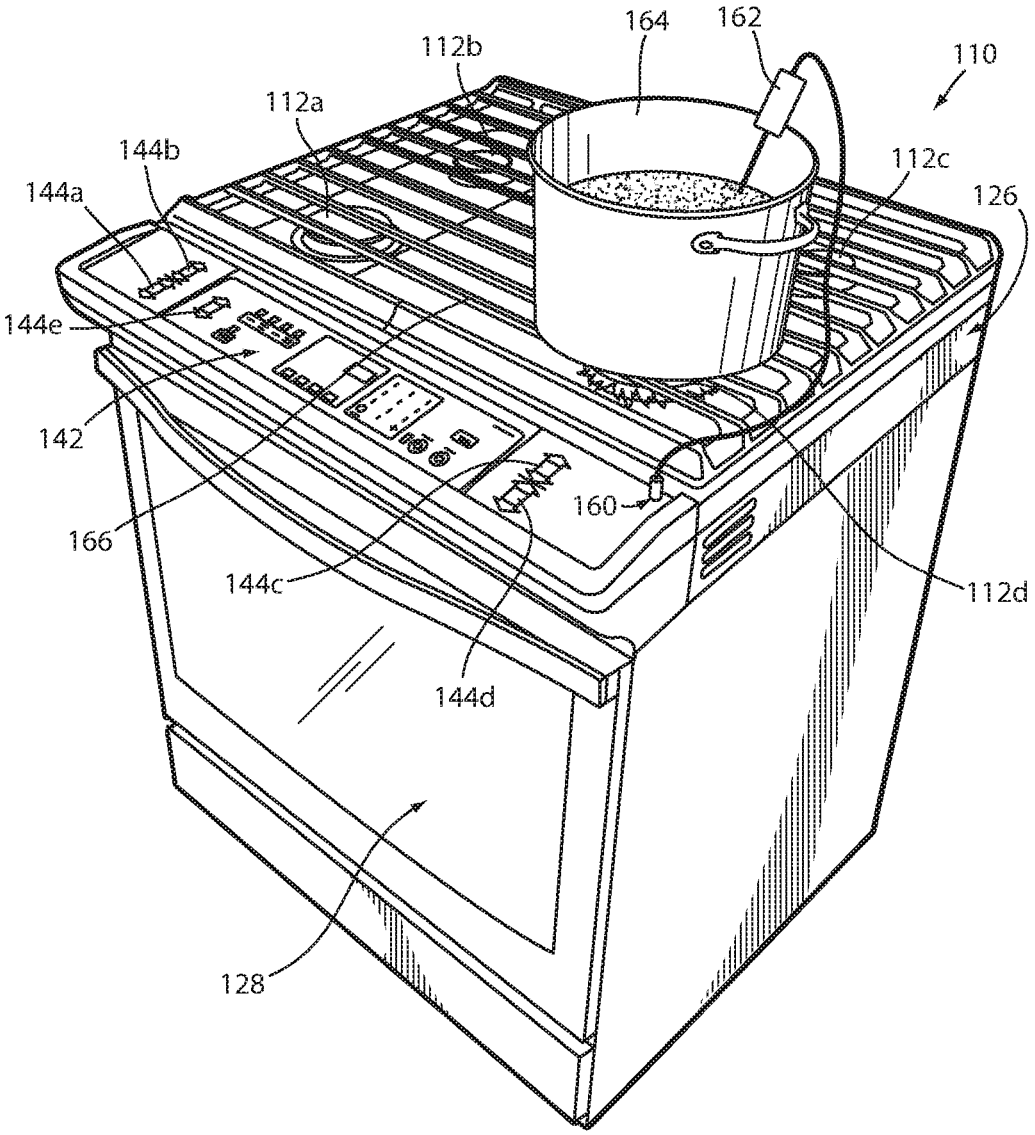
FIG. 6 is a front perspective view of variation of an appliance.

A fuel supply unit, such as fuel-supply unit 138, described with respect to FIG. 4, or fuel-supply unit 238, described with respect to FIG. 5, may be particularly useful in controlling low-level heat output from the burners 112 of a cooking hob 126, such as depicted in FIG. 6. Such control may be particularly useful in providing an appliance 110 with low-temperature cooking functionality, for example sous vide cooking. In sous vide cooking a food article to be cooked is sealed in a container, such as a vacuum-sealed bag or the like, and immersed in water that is maintained with a general level of precision at a low cooking temperature (e.g. 135° F. to 160° F.). As shown in FIG. 6, appliance 110 can be in the form of a range with a cooking hob 126 thereon. Range 110 may be configured with an input 160 coupled with a temperature monitor 162, which in FIG. 6 is shown as a temperature probe that is immersible in a pot 164 positioned for heating with burner 112*d*. Temperature monitor 162 can be in communication with controller 120 such that controller 120 can adjust the output of secondary gas flow, by way of pulsing solenoid valve 118*d* (FIG. 4), to maintain the temperature of the water within pot 164 at a desired temperature for the particular type of food item being cooked therein. In another embodiment, temperature monitor 162 can be included in an emersion circulator configured to move the water within pot 164, as is sometimes used in sous vide cooking. In the example shown, temperature monitor 162 includes a wired connection with appliance 110, however, in a variation, temperature monitor 162 can be configured for wireless connection with appliance 110. Such a wireless communication can utilize one of various wireless communication protocols, including RF, Wi-Fi, or various low-power, short-range protocols (e.g. Bluetooth™).

In another example, a temperature monitor in the form of a thermometer 162, as shown in FIG. 6 can be used in temperature-based control of burners 112 in connection with other cooking methods such as simmering or the like. In yet another example, an infrared temperature monitor can be included within cooking hob 126 to monitor the temperature of pots 164, or another similar cooking articles such as pans or the like or of grate 166, on which such articles are placed. As a similar alternative, a temperature sensor may be included in grate 166 itself or in an adjacent pad or the like, which may be spring-biased to provide reliable and consistent contact with a cooking article thereover. Such temperature sensors may be suitable for use in still further cooking methods such as searing, frying, sautéing or the like, or in providing a boiling scheme with increased efficiency (e.g. by maintaining the temperature of the liquid at or just above boiling). Controller 120 can use such monitoring to adjust the fuel flow, as discussed above, to maintain the cooking article at, or within a relatively small range of, a predetermined temperature, which may aid in cooking and may save energy.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An appliance, comprising:

a cooking hob;

a first gas-burning cooking hob burner;

a first gas path extending from an inlet to the first cooking hob burner;

a first solenoid valve positioned within the first gas path;

a second gas path extending from upstream of the first solenoid valve to the first cooking hob burner and supplying a base gas flow to the first cooking hob burner;

a controller electronically coupled with the first solenoid valve for controlling a supplemental flow of gas through the first gas path to the first cooking hob burner, the supplemental gas flow combining with the base gas flow to achieve a total gas flow.

2. The appliance of claim 1, wherein the controller further controls the supplemental flow to adjust the total gas flow by pulsing the first solenoid valve at a first rate corresponding to a desired rate of the total gas flow to the first cooking hob burner.

3. The appliance of claim 1, wherein the first solenoid valve defines an open condition and a closed condition; and the controller pulsing the valve includes executing a series of pulses at the first rate, each of said pulses including moving the first solenoid valve from closed condition to the open condition and back to the closed condition.

4. The appliance of claim 2, wherein the first rate is between about one pulse per 10 seconds and about one pulse per 0.1 seconds.

5. The appliance of claim 1, wherein the first solenoid valve is included in a first fuel injector at least partially positioned within the first gas path.

6. The appliance of claim 5, further comprising:

a second gas-burning cooking hob burner and a second solenoid valve included in a second fuel injector, wherein:

the first gas path includes a supply portion extending from the inlet, a fuel rail extending from the supply portion, a first branch extending from the fuel rail to the first cooking hob burner element; and the first and second fuel injectors are coupled with the fuel rail at intersections thereof with the first branch and the second branch, respectively.

7. The appliance of claim 1, further comprising:

a second gas-burning cooking hob burner and a second solenoid valve positioned within the first gas path, wherein:

the first solenoid valve is positioned within a first branch of the first gas path connecting the inlet with the first cooking hob burner;

the second solenoid valve is positioned within a second branch of the first gas path connecting the inlet with the second cooking hob burner; and the controller is further coupled with the second solenoid valve for controlling a second supplemental flow of gas through the second branch to the second cooking hob burner by pulsing the second solenoid valve at a second rate corresponding to a second desired total gas flow to the second cooking hob burner.

8. The appliance of claim 7, further comprising:

a digital control pad, wherein the digital control pad is electrically coupled with the controller to allow a user to adjust the first rate and the second rate.

9. The appliance of claim 1, wherein:

a second gas path extends from the inlet to the first cooking hob burner, the appliance further comprises a first mechanically-actuated valve coupled with the second gas path and positionable in a closed position and an open position, the closed position cutting off the base flow of gas through the second gas path to the first cooking hob burner, the open position permitting the base flow of gas through the second gas path to the first cooking hob burner.

10. The appliance of claim 1, further comprising:

a first mechanically-actuated valve positioned in the first gas path between the inlet and the first cooking hob burner; and a bottleneck positioned in the second gas path for restricting a flow of gas therethrough to the base gas flow;

wherein the second gas path is coupled with and extends away from the first gas path upstream of the first solenoid valve and downstream of the first mechanically actuated valve.

11. A cooking hob, comprising:

a first burner assembly and a second burner assembly;

a first gas path extending from an inlet to the first burner assembly, wherein the first gas path includes a supply portion extending from the inlet, a fuel rail extending from the supply portion, a first branch extending from the fuel rail to the first heating element, and a second branch extending from the fuel rail to the second heating element;

a first fuel injector and a second fuel injector positioned within the first gas path wherein the first and second fuel injectors are coupled with the fuel rail at intersections thereof with the first branch and the second branch, respectively; and a controller electronically coupled with the first fuel injector for controlling a flow of gas through the first gas path to the first heating element by pulsing the first fuel injector at a first rate corresponding to a desired gas flow to the first burner assembly.

12. The cooking hob of claim 11, wherein the first fuel injector includes a first solenoid valve that defines an open condition and a closed condition, the controller pulsing the fuel injector includes executing a series of pulses at the first rate, each of said pulses including moving the first solenoid valve from closed condition to the open condition and back to the closed condition.

13. The cooking hob of claim 11, wherein the fuel rail, the first fuel injector, and the second fuel injector are positioned adjacent to a rear wall of a housing of the cooking hob.

14. The cooking hob of claim 11, further comprising:

a mechanically-actuated gas lockout valve coupled with the first gas path between the inlet and the first fuel injector.

15. A cooking hob, comprising:

a first gas-burning heating element;

a first gas path extending from an inlet to the first heating element;

a first solenoid valve positioned within the first gas path;

a second gas path extending from the inlet to the first heating element and supplying a base gas flow to the first heating element;

a first mechanically-actuated valve coupled with the second gas path and positionable in a closed position and an open position, wherein when in the closed position, the first mechanical valve cuts off the base flow of gas through the second gas path to the first heating element and, when in the open position, the first mechanical valve permits the base flow of gas through the second gas path to the first heating element; and a controller electronically coupled with the first solenoid valve for controlling a supplemental flow of gas through the first gas path to the first heating element, the supplemental gas flow combining with the base gas flow to achieve a total gas flow, the controller controlling the supplemental flow to adjust the total gas flow by pulsing the first solenoid valve at a first rate corresponding to a desired rate of the total gas flow to the first heating element.

16. The cooking hob of claim 15, wherein the base flow is corresponds with a minimum fuel flow to maintain the burner in an ignited state.

17. The cooking hob of claim 16, further comprising:

a temperature monitor for communicating a temperature of an article associated with the first burner to the controller, wherein the controller adjusts the supplemental gas flow to maintain the article at a predetermined temperature.

* * * * *